US009049510B2

(12) United States Patent
Bares et al.

(10) Patent No.: US 9,049,510 B2
(45) Date of Patent: Jun. 2, 2015

(54) METHOD AND DEVICE FOR CHECKING LOUDSPEAKERS

(75) Inventors: Hervé Bares, Nanterre (FR); Christophe Bonazzi, Nanterre (FR); Samuel Lesueur, Nanterre (FR)

(73) Assignee: FINSECUR, Nanterre (FR)

( * ) Notice: Subject to any disclaimer, the term of this patent is extended or adjusted under 35 U.S.C. 154(b) by 293 days.

(21) Appl. No.: 13/637,640

(22) PCT Filed: Mar. 25, 2011

(86) PCT No.: PCT/FR2011/050662

§ 371 (c)(1), (2), (4) Date: Sep. 26, 2012

(87) PCT Pub. No.: WO2011/117557

PCT Pub. Date: Sep. 29, 2011

(65) Prior Publication Data

US 2013/0028430 A1 Jan. 31, 2013

(30) Foreign Application Priority Data

Mar. 26, 2010 (FR) ..... 10 01219
Mar. 26, 2010 (FR) ..... 10 01220

(51) Int. Cl.
*H04R 29/00* (2006.01)
*H04R 5/04* (2006.01)
*H04R 3/12* (2006.01)

(52) U.S. Cl.
CPC .. *H04R 5/04* (2013.01); *H04R 3/12* (2013.01); *H04R 29/007* (2013.01)

(58) Field of Classification Search
CPC ..... H04R 29/001; H04S 7/301
USPC ..... 381/59
See application file for complete search history.

(56) References Cited

U.S. PATENT DOCUMENTS

| | | | | |
|---|---|---|---|---|
| 6,064,742 | A * | 5/2000 | Landelius | 381/58 |
| 2003/0128850 | A1 * | 7/2003 | Kimura et al. | 381/82 |
| 2007/0223713 | A1 * | 9/2007 | Gunness | 381/59 |

FOREIGN PATENT DOCUMENTS

| | | | |
|---|---|---|---|
| DE | 10 2007 032281 | A1 | 1/2009 |
| EP | 1 657 962 | A2 | 5/2006 |
| WO | WO2008/036992 | A2 | 4/2008 |

* cited by examiner

*Primary Examiner* — Alexander Jamal
(74) *Attorney, Agent, or Firm* — Im IP Law PLLC; C. Andrew Im

(57) ABSTRACT

The method for checking loudspeakers comprises the steps of emitting a pulse over an electrical connection with the loudspeaker; measuring the electrical resistance over the connection; determining the state of the loudspeaker according to the measured resistance; and triggering a corrective action depending on the determined state of the loudspeaker. The claimed method further comprises the steps of associating a plurality of amplification systems to different subsets of the plurality of loudspeakers; assigning different signals to be emitted by different loudspeakers for each of a plurality of control signals; and storing parameters representing the signals to be emitted in each amplification system. When a control signal common to the different amplification systems is received, the amplification systems cause the loudspeakers to emit the different signals and the corrective action comprises memorizing the parameters representing the status of the loudspeaker.

17 Claims, 4 Drawing Sheets

METHOD AND DEVICE FOR CHECKING LOUDSPEAKERS

RELATED APPLICATIONS

This application is a §371 application from PCT/FR2011/050662 filed Mar. 25, 2011, which claims priority from French Patent Application No. 10 01219 filed Mar. 26, 2010 and French Patent Application No. 10 01220 filed Mar. 26, 2010, each of which is incorporated herein by reference in its entirety.

TECHNICAL FILED OF THE INVENTION

This invention concerns a method and a device for checking loudspeakers. It applies in particular to checking the working order of warning siren loudspeakers located outdoors and to transmitting alert signals over a site.

BACKGROUND OF THE INVENTION

Security system sirens and loudspeakers are critical elements in gathering and/or evacuating people during an incident, a fire, a natural or industrial disaster. Checking their working order on a regular basis is therefore required.

It is known to send direct current over the electrical connection that supplies a loudspeaker and to measure the resistance over this connection. Depending on the resistance measured, it can be determined whether the loudspeaker's coil is supplied by the connection and is in working order.

However, this technique has a number of drawbacks. Firstly, the continuous consumption of electrical power is not negligible. Secondly, permanently maintaining the loudspeaker membrane in an offset position in relation to its power-off balance position, causes this membrane to deteriorate, causes mechanical problems with the coil and encourages corrosion effects. In particular, the inventors have discovered that it is this continuous supply to the coil of some loudspeakers located outdoors that causes their soiling with dust, sand or salt.

This soiling causes:

matter to accumulate and a crust to form on the loudspeaker's membrane.

The result of these drawbacks, in particular, is that the loudspeaker ages and the sound power it emits for the same electrical control signal gradually decreases. Thus, the loss of efficiency of these loudspeakers is accelerated.

OBJECT AND SUMMARY OF THE INVENTION

The aim of this invention is to remedy these drawbacks.

To this end, according to a first aspect, the present invention envisages a method for checking loudspeakers that comprises:

- a step in which a pulse is sent over an electrical connection with the loudspeaker;
- a step in which the electrical resistance over said connection is measured;
- a step in which the state of the loudspeaker is determined according to said resistance and
- a step in which a corrective action is triggered, depending on the determined state of the loudspeaker.

Thanks to these provisions, the problems linked to the use of direct current, mentioned above, are avoided. In particular, the emission of an audible sound is caused during the displacement of the membrane; this allows the proper operation to be checked by a person or a system in charge of the verification moving in the vicinity of the loudspeaker. In addition, the mechanical pulse that results from the electrical pulse to the loudspeaker's coil removes the crust from the membrane. It can be seen that the corrective action may comprise triggering an alert signal, a maintenance operation, a more powerful electrical pulse and/or an increase in the amplification factor of an amplifier associated with said loudspeaker.

According to particular features, during the step in which the pulse is emitted, a pulse comprising at least one audible frequency is emitted.

This facilitates the verification by an inspector located in the vicinity of the loudspeaker, in particular when there are a large number of loudspeakers installed on a site, e.g. along the length of a tunnel.

According to particular features, during the step in which the pulse is emitted, a voltage of about 100 Volts is utilized.

Thanks to these provisions, the loudspeaker can be located further away from the electrical pulse emitter than if a lower voltage were used.

According to particular features, during the step in which the pulse is emitted, a pulse of between 50 milliseconds and 500 milliseconds in duration is emitted.

These pulse durations are designed to provide, firstly, good audibility for an inspector moving on the site and, secondly, an accurate measurement of the resistance when the loudspeaker has reached a stable position.

According to particular features, during the step in which the pulse is emitted, a pulse is emitted at a time interval of less than 100 seconds in duration.

Thus, malfunctions are detected quickly.

According to particular features, said corrective action comprises triggering an alert signal, a maintenance operation and/or a more powerful electrical pulse.

According to particular features, the method that is the subject of this invention comprises in addition:

- a step in which a plurality of amplification systems is associated to different subsets of the plurality of loudspeakers;
- a step in which different signals to be emitted by different loudspeakers are assigned for each of a plurality of control signals;
- a step in which parameters representing said signals to be emitted are stored in each amplification system when a control signal common to the different amplification systems is received, with the amplification systems causing the loudspeakers to emit the different signals and said corrective action comprising memorizing the parameters representing the status of said loudspeaker.

According to particular features, at least one said amplification system comprises memorizing values of operational parameters; the amplification system is designed to utilize operational parameter values stored upon receiving a predefined signal.

According to particular features, at least one said amplification system comprises memorizing amplification levels; the amplification system is designed to utilize an amplification level stored upon receiving a predefined signal.

According to particular features, at least one said amplification system comprises a memory of sounds to be emitted; the amplification system is designed to utilize sounds stored upon receiving a predefined signal.

Thanks to each of these provisions, each amplification system can be configured before it is caused to emit a sound; the triggering signal can then be identical for all the amplification systems.

According to particular features, at least one said amplification system is connected to a control center by a computer link.

The link between the control center and each amplification system thus becomes digital, with the advantages this brings in terms of resilience to interference, of error correction capability, of energy losses, etc.

According to particular features, at least one said amplification system comprises a means of checking the operation of at least one said loudspeaker.

According to particular features, the device that is the subject of this invention comprises at least one sensor of a physical dimension, where the control signal depends on the signal emitted by said sensor.

For example, a sensor determines the direction and strength of the wind; the command corresponds, for some loudspeakers, to a signal to take shelter and, for other loudspeakers, to an evacuation signal; which loudspeakers are concerned depends on the strength and direction of the wind.

According to particular features, the method according to the invention comprises a step in which the ambient noise is captured by a sensor, before a sound signal is emitted by said loudspeaker upon receiving a control signal common to the different amplification systems; the amplification systems cause said loudspeakers to emit the different signals at levels that vary depending on the signal emitted by said sensor to represent the ambient noise.

According to particular features, the method according to the invention comprises a step in which the sound signal emitted by the loudspeaker is captured by a sensor upon receiving a control signal common to the different amplification systems; the amplification systems cause said loudspeakers to emit the different signals at levels that vary depending on the signal emitted by said sensor to represent the sound signals emitted.

Thanks to each of these provisions, the level of the sound signals emitted by the loudspeaker can be adjusted to the ambient noise and to the loudspeaker's response.

According to particular features, the method according to the invention comprises a step in which the sound emitted by the loudspeaker is captured by a sensor during the pulse; the step of triggering the corrective action depends on the signal emitted by said sensor to represent the sound emitted by the loudspeaker.

Thanks to each of these provisions, the level of the sound signals emitted by the loudspeaker can be adjusted to the ambient noise and to the loudspeaker's impulse response. In addition, aging or other problems of the loudspeaker can be detected, depending on the loudspeaker's impulse response.

According to a second aspect, this invention envisages a loudspeaker checking device that comprises:

- a means of sending a pulse over an electrical connection with the loudspeaker;
- a means of measuring the electrical resistance over said connection;
- a means of determining the state of the loudspeaker according to said resistance and
- a means of triggering designed to trigger a corrective action, depending on the determined state of the loudspeaker.

According to particular features, the device that is the subject of this invention comprises in addition:

- a means of associating a plurality of amplification systems to different subsets of the plurality of loudspeakers;
- a means of assigning different signals to be emitted by different loudspeakers for each of a plurality of control signals.
- a storage means for parameters representing said signals to be emitted in each amplification system when a control signal common to the different amplification systems is received, with the amplification systems causing the loudspeakers to emit the different signals and the means of triggering being adjusted to the fact that said corrective action comprises memorizing the parameters representing the status of said loudspeaker.

As the advantages, aims and special features of this device, which is the subject of the second aspect of this invention, are similar to those of the method that is the subject of first aspect of the present invention, as described in brief above, they are not repeated here.

It is also known to arrange sirens over a site and to implement a control center that comprises an amplification chain to transmit the same signal at the same intensity to all the siren's loudspeakers, such that all the sirens emit this signal.

However, this technique has a number of drawbacks. Firstly, it does not allow different audible signals to be emitted to different areas of the site and they do not allow a broadcast area to be defined depending on the circumstances. The inventors have determined, for example during a chemical disaster with gases released in the atmosphere, depending on the prevailing wind, that different signals have to be broadcast in the downwind area, e.g. to incite people at risk of exposure to take shelter and, in the other areas, e.g. to cause an evacuation.

This invention also aims to remedy these drawbacks.

To this end, according to a third aspect, this invention envisages a loudspeaker checking device that comprises:

- a plurality of loudspeakers and
- a plurality of amplification systems connected to different subsets of the plurality of loudspeakers.

Thanks to these provisions, different signals can be emitted with different power levels to different areas of the site and/or its vicinity.

According to particular features, at least one said amplification system comprises memorizing values of operational parameters; the amplification system is designed to utilize operational parameter values stored upon receiving a predefined signal.

According to particular features, at least one said amplification system comprises memorizing amplification levels; the amplification system is designed to utilize an amplification level stored upon receiving a predefined signal.

According to particular features, at least one said amplification system comprises a memory of sounds to be emitted; the amplification system is designed to utilize sounds stored upon receiving a predefined signal.

Thanks to each of these provisions, each amplification system can be configured before it is caused to emit a sound; the triggering signal can then be identical for all the amplification systems.

According to particular features, at least one said amplification system is connected to a control center by a computer link.

The link between the control center and each amplification system thus becomes digital, with the advantages this brings in terms of resilience to interference, of error correction capability, of energy losses, etc.

According to particular features, at least one said amplification system comprises a means of checking the operation of at least one said loudspeaker.

According to particular features, the device that is the subject of this invention comprises at least one sensor of a physical dimension, where the control signal depends on the signal emitted by said sensor.

For example, a sensor determines the direction and strength of the wind; the command corresponds, for some loudspeakers, to a signal to take shelter and, for other loudspeakers, to an evacuation signal; which loudspeakers are concerned depends on the strength and direction of the wind.

According to a fourth aspect, the present invention envisages a method for checking a plurality of loudspeakers that comprises:

- a step in which a plurality of amplification systems is associated to different subsets of the plurality of loudspeakers;
- a step in which different signals to be emitted by different loudspeakers are assigned for each of a plurality of control signals;
- a step in which parameters representing said signals to be emitted are stored in each amplification system upon receiving a control signal common to the different amplification systems; the amplification systems cause the different signals to be emitted to said loudspeakers.

As the advantages, aims and special features of the method that is the subject of the fourth aspect of this invention are similar to those of the device that is the subject of third aspect of the present invention, as described in brief above, they are not repeated here.

The different characteristics of the different aspects of this invention are advantageously combined to make up a method and a device for checking loudspeakers. In particular, the corrective action typical of the first two aspects of the invention can comprise increasing the amplification factor of an amplifier associated to said loudspeaker, in accordance with the third and fourth aspects of the invention.

BRIEF DESCRIPTION OF THE DRAWINGS

Other advantages, aims and characteristics of the present invention will become apparent from the description that will follow, made, as an example that is in no way limiting, with reference to the drawings included in an appendix, in which.

DETAILED DESCRIPTION OF THE EMBODIMENTS

Figure 1:
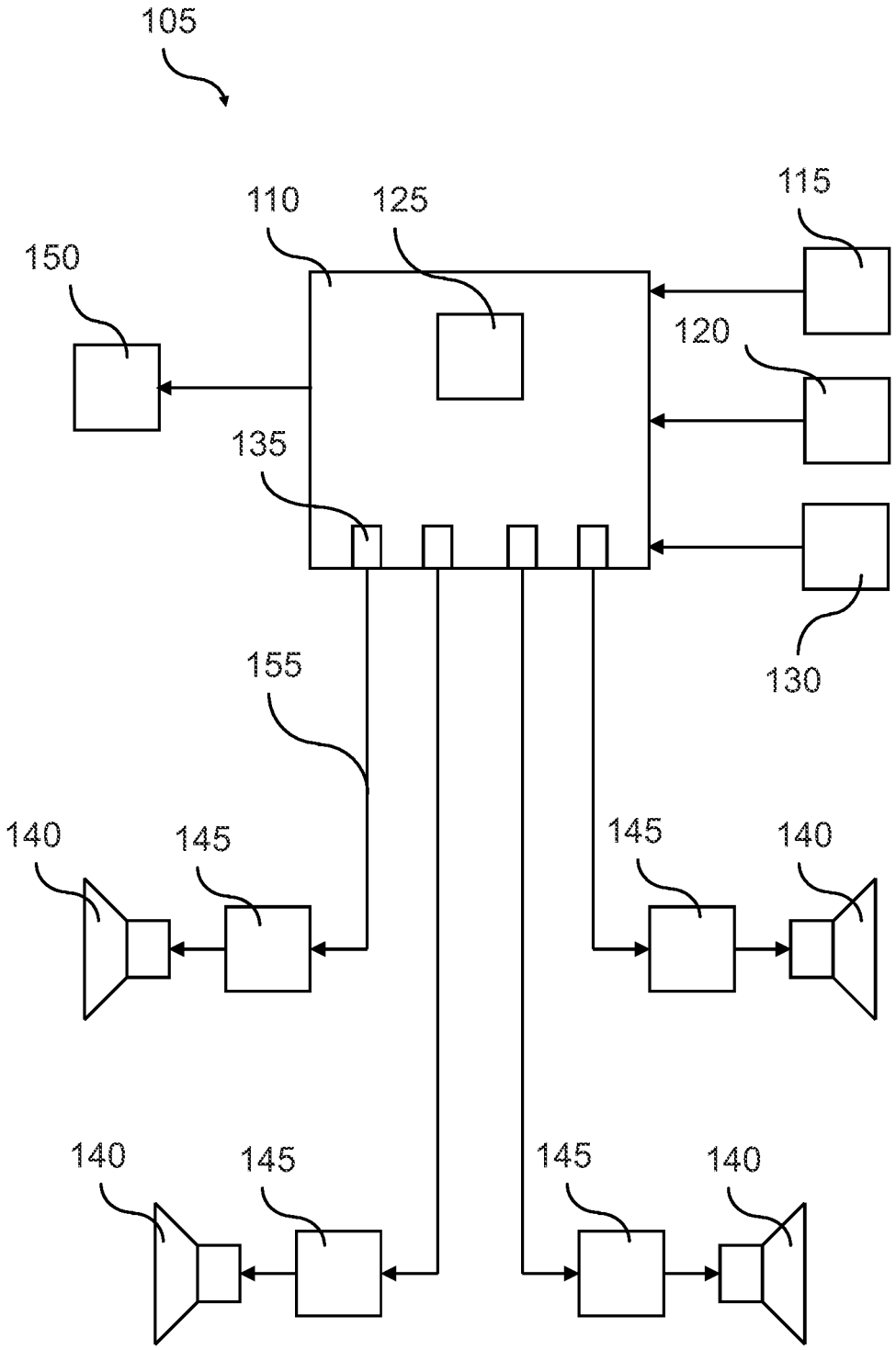
FIG. 1 represents, schematically, a first embodiment of the device that is the subject of this invention, built into a security system.

FIG. 1 shows a device, which is the subject of this invention 105 that comprises an alert central unit 110 with a microprocessor 125, whose inputs are connected to physical dimension sensors, e.g. smoke detectors 115 and alert detectors 120. Some of the microprocessor 125 inputs are also connected to a network 130. In particular embodiments, at least one physical dimension sensor is designed to detect a type of danger; the location of this danger is determined according to the location of this sensor and/or at least one physical dimension sensor is designed to determine wind direction and/or strength.

The outputs 135 of the microprocessor 125 are connected to links 155 leading to loudspeakers 140 by means of amplification devices 145 and of a network 150. The terms "input" and "output" must be taken here as indicating the main direction of transmission of the information linked to an incident. It does not preclude having information moving in the opposite direction, e.g. for configuration, verification or maintenance purposes.

The alert central unit 110 is of known type, with the exception of the functions specific to the implementation of the present invention. It receives signals from the smoke detectors 115, the alert detectors 120 and the network 130. In known manner, in the case where the detectors detect abnormal conditions or where triggering signals are received from the network 130, the central unit 110 triggers alert signals remotely over the network 150 and emits audible signals towards the amplification devices 145 of the loudspeakers 140. These signals represent a type of danger, in the manner prescribed by regulations.

It should be noted that the networks 130 and 150 can be one and the same. These networks are computer and/or telecommunications networks.

Preferably, the connections 155 between the central unit 110 and the amplification devices 145 are digital connections, e.g. Ethernet (registered trademark) type.

The microprocessor 125 is designed to cause the central unit 110 to emit a pulse over the electrical link with each loudspeaker 140 amplification device 145. During this pulse, the microprocessor 125 is designed to measure the electrical resistance over each link 155, for example by measuring the amperage of the electrical current going through this link 155 and by dividing the voltage delivered during the pulse by this amperage. The microprocessor 125 is designed to determine the state of each loudspeaker 140 according to the resistance measured. For example, the microprocessor 125 compares the resistance measured to two limit values, upper and lower; it then determines that the loudspeaker 140 is in working order if the resistance measured falls between these two limit values. If such is not the case, the microprocessor 125 triggers an alert over the network 150. The operation of the microprocessor 125 is shown in detail with reference to FIG. 3.

It should be noted that, depending on the variants, the pulses are sent simultaneously to the outputs 135 or sequentially to one, then to the other output 135.

Preferably, the microprocessor 125 causes the central unit 110 to emit a pulse comprising at least one audible frequency. In this way, an auditory verification can be easily performed by going over the site on which the loudspeakers 140 are located.

In embodiments, the pulse is carried by a voltage of approximately 100 Volts +/−30%. These embodiments are particularly suitable for long links. In embodiments, each pulse has a duration of between 50 milliseconds and 500 milliseconds.

In embodiments, the microprocessor 125 causes a pulse to be emitted to each loudspeaker 140 at a time interval of between 20 and 200 minutes. In this way, the disturbance caused by the pulses is less frequent.

In embodiments, the microprocessor 125 causes a pulse to be emitted by the control unit 110 to each loudspeaker 140 at a time interval of less than 100 seconds. Thus, malfunctions are detected more quickly.

Figure 2:
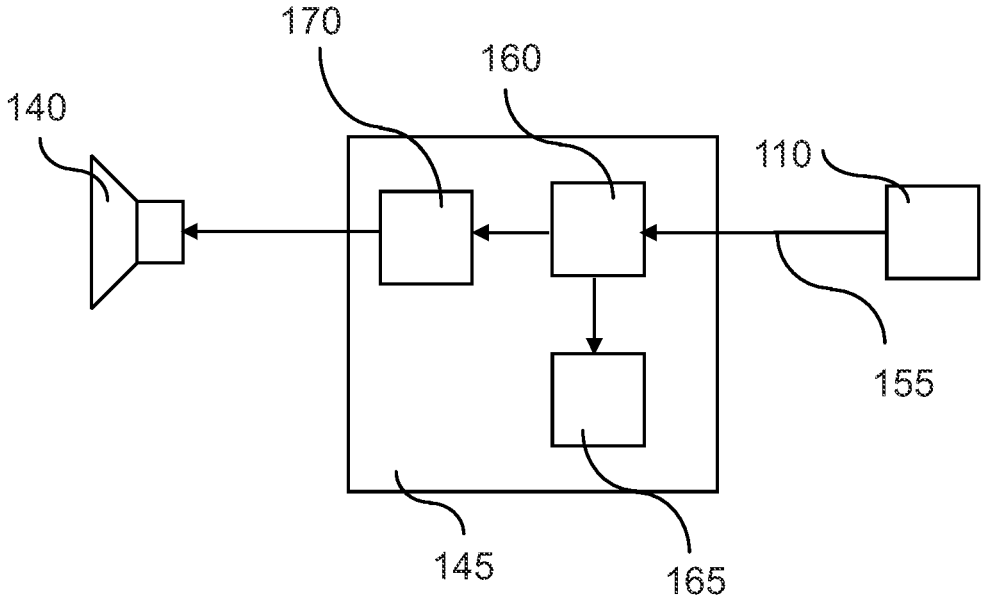
FIG. 2 represents, schematically, a particular embodiment of an amplification device illustrated in FIG. 1.

FIG. 2 shows an amplification device 145, which receives messages from a control unit 110 via a link 155 and emits amplified signals towards a loudspeaker 140. This amplification device comprises a microprocessor 160, non-volatile memory 165 and an amplifier 170. The microprocessor 160 receives messages from the control unit 110, writes to and reads from the memory 165 and controls the signals amplified by the amplifier 170 and broadcast by the loudspeaker 140, according to the information read from the memory 165.

The microprocessor 160 receives and memorizes, in particular, operating parameter values, amplification levels and sounds to be emitted. On receiving a predefined alert message, the microprocessor reads the parameter values, the amplification level, and the sounds to be utilized from the memory 165; it causes an amplified tone to be emitted that represents the sounds read and the sound level read.

For example, an alert message represents: an instruction to evacuate the entire site; an instruction to evacuate part of the site and to seek shelter in another part of the site; an instruction to evacuate part of the site and to assemble the people in another part of the site; all this, given that the parts of the site under consideration may depend on the type of the danger and its movements, e.g. of the prevailing winds, etc. Each of these messages corresponds, for each amplification device, to sounds to be emitted and to a sound level to be used.

Thus, each amplification system can be configured before it is caused to emit a sound; the triggering signal can then be identical for all the amplification systems.

The loudspeaker checking device 105 thus comprises:

a plurality of loudspeakers 140 and a plurality of amplification systems 145 connected to different subsets of the plurality of loudspeakers.

In the embodiment described and shown in FIGS. 1 and 2, each amplification system is connected to a single loudspeaker. However, in other embodiments, at least one amplification system is connected to several loudspeakers. By implementing this invention, different signals can be caused to be emitted with different power levels to different areas of the site and/or its vicinity.

Figure 3:
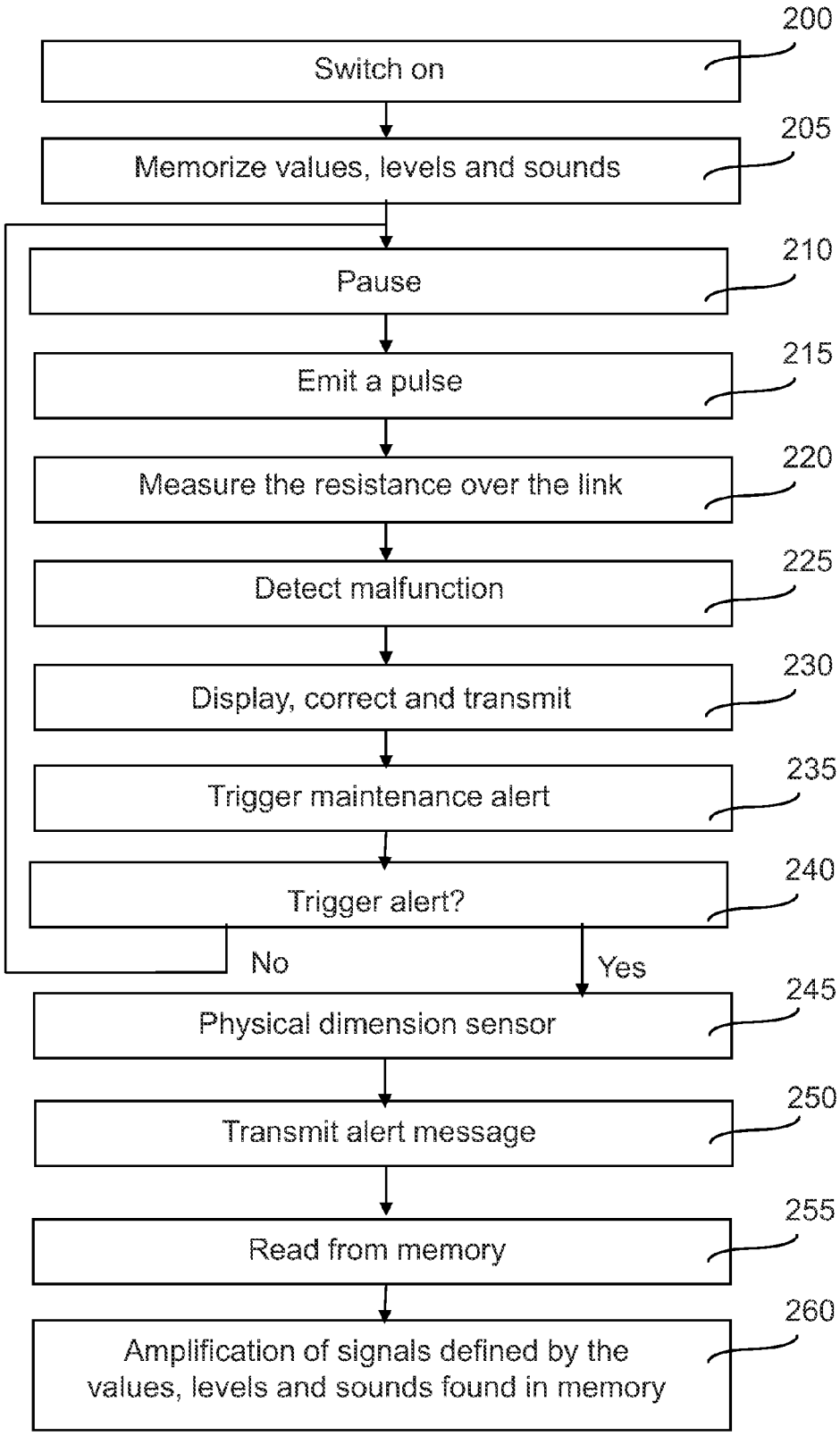
FIG. 3 represents, as a logic diagram, steps in the operation of the device illustrated in FIG. 1.

FIG. 3 shows that, during a step 200, the device 105 is set into operation. During a step 205, the parameter values, amplification levels and sounds to be emitted for each alert message and each loudspeaker 140, are transmitted from the control unit 110 towards the amplification device 145 associated to said loudspeaker 140. These data items are stored in the memories 165 of the amplification devices 145.

Then, during a step 210, the microprocessor 125 performs a pause, i.e. a countdown of a predefined duration is performed. As indicated above, this predefined duration is, in embodiments, between 20 and 200 minutes and, in other embodiments, less than 100 seconds.

During a step 215, at the end of the predefined duration, the microprocessor 125 causes the control unit 110 to emit a pulse for each loudspeaker 145.

During a step 220, the microprocessor 125 measures the resistance over the link with each loudspeaker 145. During a step 225, the microprocessor determines, according to the measured resistance, if a malfunction was detected over one of the links.

During a step 230, the microprocessor causes a message representing the result of step 225 to be displayed and transmitted remotely. During a step 235, if the changes in measured resistance are of a predefined type, e.g. it moves towards a limit value or alternates between two distant values, the microprocessor 125 causes a corrective action to be triggered. For example, the microprocessor 125 causes an alert message requesting maintenance operations to be displayed and emitted. In embodiments, the microprocessor causes, for the loudspeaker in question, a more powerful electrical pulse or parameters representative of the state of said loudspeaker to be memorized, for example, and increase in the gain of the amplifier associated to said loudspeaker or an increase in the memorized power of the signal to be transmitted to said loudspeaker.

During a step 240, which is shown after step 235 but is actually performed continuously in parallel with steps 210 to 235, it is determined whether an alert must be triggered, either depending on signals received from sensors, or depending on signals received over the network 130. If not, then return to step 210.

If an alert is to be triggered, a capture of a physical dimension is performed during a step 245. For example, the wind direction and/or strength and/or the type and/or the location of a danger are measured. Depending on at least one of these physical dimensions, a control signal, also called "alert message" is determined for each of the amplification devices.

For example, the amplification devices of the loudspeakers downwind of a chemical incident memorize a signal calling people to take shelter, whereas the amplification devices of the loudspeakers upwind from the location of the incident memorize an evacuation signal. Conversely, for a fire, the messages or signals may be reversed.

It can be seen that the amplification devices can have in memory, beforehand, a set of sound signals to be emitted, with the control signal representing directly the location and type of the danger and the wind direction.

During a step 250, the alert message that corresponds to the danger and to its evolution is transmitted from the control unit 110 to all the amplification devices. In embodiments, the alert message represents the value of the physical dimension captured during step 245, as described above, with reference to this step 245.

During a step 255, each amplification device 145 processor 160 reads the parameter values, amplification level and sounds to be emitted from the memory 165. During a step 260, each processor causes the sound signals that correspond to these values, level and sounds to be amplified and broadcast.

Figure 4:
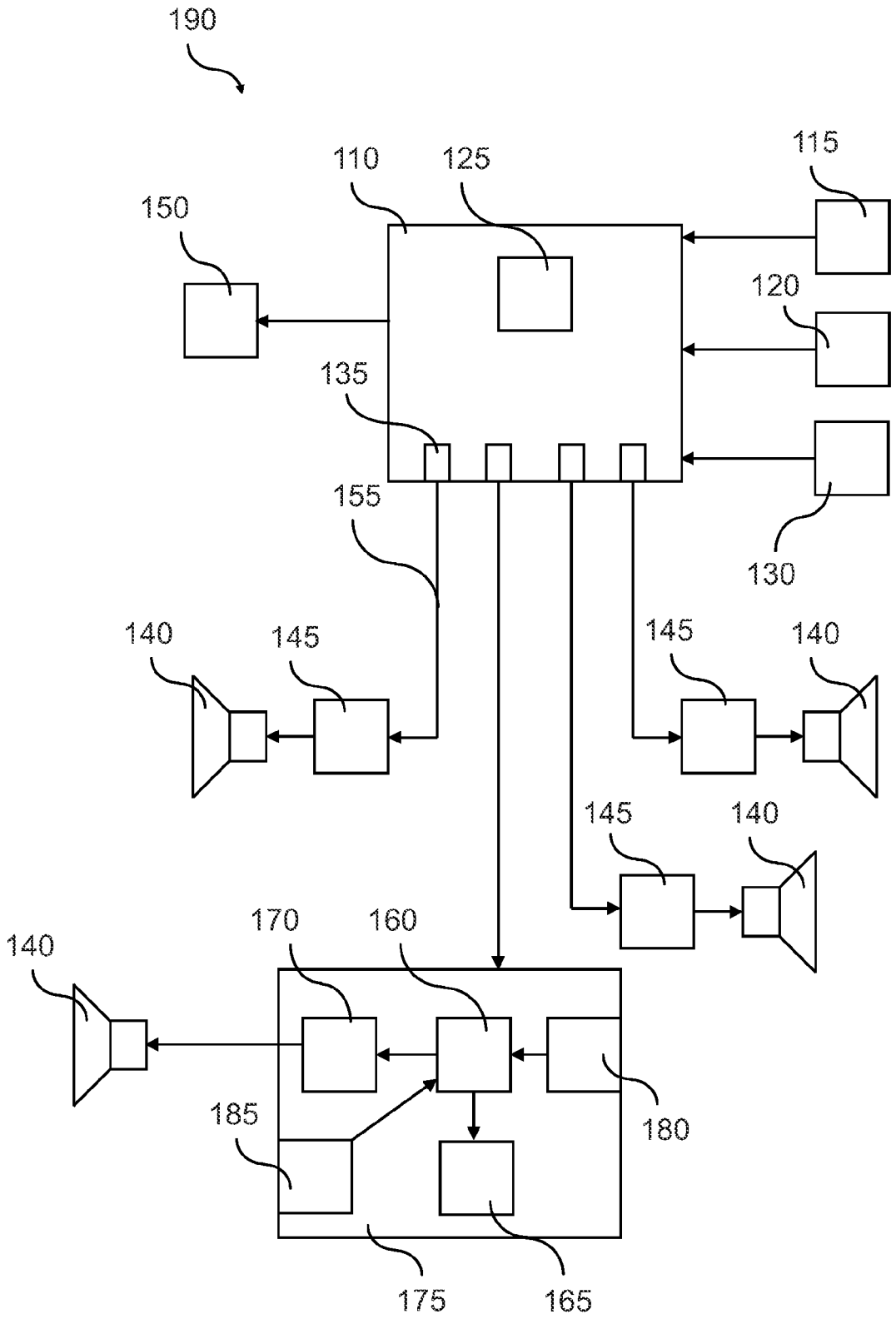
FIG. 4 represents, schematically, a second particular embodiment of the device that is the subject of this invention.

In the second embodiment 190 of the device that is the subject of the invention, illustrated in FIG. 4, the same elements as in the first embodiment illustrated in FIGS. 1 and 2 are found, except for the at least one (one, here) amplification device 145, which is replaced by an amplification device 175. The amplification device 175 comprises, in addition to the microprocessor 160, the non-volatile memory 165 and the amplifier 170, an ambient noise sensor 185 and a sensor 190 of a physical dimension representative of a danger. The sensor 185 is, for example, a microphone of known type. The sensor 190 is, for example, a detector of fire, smoke, heat, radiation—radioactive in particular—gas or intrusions.

The amplification device 175 receives messages from a control unit 110 via a link 155 and emits amplified signals towards a loudspeaker 140. More specifically, it is the microprocessor 160 that receives messages from the control unit 110, writes to and reads from the memory 165 and controls the signals amplified by the amplifier 170 and broadcast by the loudspeaker 140, according to the information read from the memory 165.

As described with regard to the first embodiment, the microprocessor 160 receives and memorizes, in particular, operating parameter values, amplification levels and sounds to be emitted. On receiving a predefined alert message, the microprocessor reads the parameter values, the amplification level, and the sounds to be utilized from the memory 165; it causes an amplified tone to be emitted that represents the sounds read and the sound level read.

For example, an alert message represents: an instruction to evacuate the entire site; an instruction to evacuate part of the site and to seek shelter in another part of the site; an instruction to evacuate part of the site and to assemble the people in another part of the site; all this, given that the parts of the site under consideration may depend on the type of the danger and its movements, e.g. of the prevailing winds, etc. Each of these messages corresponds, for each amplification device, to sounds to be emitted and to a sound level to be used.

Thus, each amplification system can be configured before it is caused to emit a sound; the triggering signal can then be identical for all the amplification systems.

In addition to the functions already described about the first embodiment, the microprocessor 160 realizes and communicates the following to the control unit 110:

a danger detection, via the sensor 180;

a measurement of the initial ambient noise before the sound emission by the loudspeaker 140 is triggered;

a measurement of the of the emitted sound level after the sound emission by the loudspeaker 140 is triggered;

a measurement of the sound level before and during a sound pulse as described with regard to FIGS. 1 to 3.

When a sound emission is triggered, the amplifier 170 is controlled, firstly, according to the initial ambient noise level. For example, the amplifier 170 is controlled to cause the loudspeaker 140 to emit a signal 10 dB above the ambient noise.

In variants, during the sound emission, the amplifier 170 is controlled according to the emission level. Again, the amplifier 170 is controlled to cause the loudspeaker 140 to emit a signal, for example, 10 dB above the ambient noise.

Examples of application of this operation are given below.

In a tunnel, the ambient sound levels can be very different, depending on the amount of traffic and on whether the fans are in operation. The output of the alert signal, 10 dB above the ambient noise, can cause the level of the sirens to vary from 100 to 120 dB.

In the context of an internal organization plan, a company is asked to warn their employees without disturbing the neighborhood. The operation as described above allows the maximum efficiency of the alert signal to be provided, without disturbing the population of the surroundings.

In the context of installing equipment in a medium with a very high level of background noise (steelworks, glass works, etc.) the sound diffusers must cover the ambient noise. This ambient noise can be more or less loud depending on the level of use of the machines. The operation as described above allows broadcasting at the power required to be heard even when wearing noise protection helmets, but not above what is necessary, thus limiting the workers' sound exposure.

In variants, the noise caused by the sound impulse emitted by the loudspeaker 140 is detected and measured automatically, either locally by the microprocessor 160 or at the control unit 110.

Measuring the sound level of the ambient noise also makes it possible to check, from a zero reading (commissioning or maintenance operation) for a drift in sound levels during monthly tests and possibly trigger preventive maintenance operations.

The invention claimed is:

1. A method for checking loudspeakers, comprising the steps of:

associating a plurality of amplification systems to different subsets of a plurality of loudspeakers;

assigning different signals to be emitted by different loudspeakers for each of a plurality of control signals;

storing parameters representing the control signals to be emitted in each amplification system;

emitting a pulse over an electrical connection with a loudspeaker;

measuring an electrical resistance over said connection;

determining a state of the loudspeaker in accordance with said resistance;

capturing a sound emitted by the loudspeaker by a sensor during the pulse; and triggering a corrective action in accordance with the determined state of the loudspeaker and the signal emitted by said sensor representative of the sound emitted by the loudspeaker, triggering the corrective action to memorize the parameters representing a status of said loudspeaker when a control signal common to the different amplification systems is received, the amplification systems causing the loudspeakers to emit different signals.

2. The method of claim 1, further comprising the step of emitting the pulse comprising at least one audible frequency.

3. The method of claim 1, further comprising the step of emitting the pulse utilizing a voltage of 100 Volts.

4. The method of claim 1, further comprising the step of emitting the pulse for a duration of 50-500 milliseconds.

5. The method of claim 1, further comprising the step of emitting the pulse at a time interval of less than 100 seconds in duration.

6. The method of claim 1, wherein the step of triggering said corrective action comprises the step of triggering an alert signal, a maintenance operation or a maximum electrical pulse.

7. The method of claim 1, further comprising the steps of memorizing values of the parameters by at least one amplification system, and utilizing stored parameter values upon receipt of a predefined signal by said at least one amplification system.

8. The method of claim 1, further comprising the steps of memorizing amplification levels by at least one amplification system, and utilizing a stored amplification level upon receipt of a predefined signal by said at least one amplification system.

9. The method of claim 1, further comprising the steps of memorizing sounds to be emitted by at least one amplification system and utilizing stored sounds upon receipt of a predefined signal by said at least one amplification system.

10. The method of claim 1, further comprising the step of connecting at least one amplification system to a control center by a computer link.

11. The method of claim 1, further comprising the step of checking operation of at least one loudspeaker by at least one amplification system.

12. The method of claim 1, wherein a control signal depends on a signal emitted by at least one sensor of a physical dimension.

13. The method of claim 1, further comprising the steps of capturing an ambient noise by a sensor, before a sound signal is emitted by said loudspeaker upon receipt of a control signal common to different amplification systems; and controlling said loudspeakers to emit different signals at levels that vary in accordance with the signal emitted by the sensor to represent the ambient noise by the amplification systems.

14. The method of claim 1, further comprising the step of capturing a sound signal emitted by said loudspeaker by a sensor upon receipt of a control signal common to different amplification systems; and controlling said loudspeakers to emit different signals at levels that vary in accordance with the signal emitted by the sensor the amplification systems cause said loudspeakers to emit the different signals at levels that vary depending on the signal emitted by said sensor to represent the emitted sound signal.

15. Apparatus for checking loudspeakers, comprising:

an associating device to associate a plurality of amplification systems to different subsets of a plurality of loudspeakers;

an assigning device to assign different signals to be emitted by different loudspeakers for each control signal;

a memory to store parameters representing the signals to be emitted in each amplification system;

an emitting device to emit a pulse over an electrical connection with the loudspeaker;

a measuring device to measure the electrical resistance over said connection;

a device to determine a state of the loudspeaker in accordance with the measured resistance;

a sensor to capture a sound emitted by the loudspeaker during the pulse; and a triggering device to trigger a corrective action in accordance with the determined state of the loudspeaker and the signal emitted by the sensor to represent the sound emitted by the loudspeaker, and to memorize the parameters representing a status of the loudspeaker when a control signal common to the different amplification systems is received, the amplification systems causing the loudspeakers to emit the different signals.

16. Apparatus of claim 15, wherein the sensor is configured to capture an ambient noise before the loudspeakers emit sound signals; and wherein the amplification systems, on receipt of a control signal, are configured to cause the loudspeakers to emit the different signals at levels that vary in accordance with a signal emitted by the sensor to represent the ambient noise.

17. Apparatus of claim 15, wherein the sensor is configured to capture sound signals emitted by the loudspeakers upon receiving a control signal common to different amplification systems; and wherein the amplification systems are configured to cause the loudspeakers to emit the different signals at levels that vary in accordance with a signal emitted by the sensor to represent the emitted sound signals.

* * * * *